US011168418B2

(12) United States Patent
Bathelier et al.

(10) Patent No.: US 11,168,418 B2
(45) Date of Patent: Nov. 9, 2021

(54) METHOD OF MANUFACTURING AN INTERIOR COVERING, NOTABLY A FLOOR COVERING FOR A MOTOR VEHICLE

(71) Applicant: FAURECIA AUTOMOTIVE INDUSTRIE, Nanterre (FR)

(72) Inventors: Xavier Bathelier, Saint Pierremont (FR); Daniel Baudet, Mouzon (FR)

(73) Assignee: FAURECIA AUTOMOTIVE INDUSTRIE, Nanterre (FR)

( * ) Notice: Subject to any disclaimer, the term of this patent is extended or adjusted under 35 U.S.C. 154(b) by 512 days.

(21) Appl. No.: 15/759,111

(22) PCT Filed: Aug. 31, 2016

(86) PCT No.: PCT/EP2016/070508

§ 371 (c)(1),
(2) Date: Mar. 9, 2018

(87) PCT Pub. No.: WO2017/042076

PCT Pub. Date: Mar. 16, 2017

(65) Prior Publication Data

US 2018/0282919 A1 Oct. 4, 2018

(30) Foreign Application Priority Data

Sep. 10, 2015 (FR) ..... 1558413

(51) Int. Cl.
*D04H 1/485* (2012.01)
*D04H 3/105* (2012.01)
(Continued)

(52) U.S. Cl.
CPC ..... *D04H 1/485* (2013.01); *D04H 1/46* (2013.01); *D04H 1/74* (2013.01); *D04H 3/105* (2013.01); *D04H 11/08* (2013.01)

(58) Field of Classification Search
CPC ..... D04H 11/08; D04H 1/46; D04H 1/485; D04H 3/105; D04H 1/74; Y10T 156/1023;
(Continued)

(56) References Cited

U.S. PATENT DOCUMENTS 4,651,393 A 3/1987 Dilo et al.
5,239,734 A 8/1993 Bathelier et al.
(Continued)

FOREIGN PATENT DOCUMENTS

EP 0183952 A1 6/1986
EP 0859077 A1 8/1998
(Continued)

OTHER PUBLICATIONS

International Search Report for International application No. PCT/EP2016/070508, dated Oct. 31, 2016, 3 pages.
(Continued)

*Primary Examiner* — Camie S Thompson
(74) *Attorney, Agent, or Firm* — Reising Ethington P.C.

(57) ABSTRACT

A manufacturing method includes: a step for producing a batt of fibers, elongated in a longitudinal direction, by batting with interlacing of the fibers, a step for passing the batt of fibers, in the longitudinal direction, through a loop-forming device having a set of rotary discs and stationary loop-forming elements, so as to generate undulations, and, following the passing step, a step for bringing the batt of fibers onto a conveyor equipped with brushes, and accumulating the undulations in the brushes so as to achieve a predetermined density.

14 Claims, 4 Drawing Sheets

(51) Int. Cl.
*D04H 11/08* (2006.01)
*D04H 1/46* (2012.01)
*D04H 1/74* (2006.01)

(58) Field of Classification Search
CPC ..... Y10T 428/23986; B32B 2471/00; B32B 2307/72; B32B 3/28; B32B 5/06; B32B 5/26; B32B 2305/18
USPC ..... 156/209, 85; 428/95, 85; 28/107, 159
See application file for complete search history.

(56) References Cited

U.S. PATENT DOCUMENTS

| | | | | |
|---|---|---|---|---|
| 5,387,454 | A | 2/1995 | Werner | |
| 6,432,234 | B1 | 8/2002 | Bathelier | |
| 2004/0247821 | A1* | 12/2004 | Zafiroglu | B32B 37/144 428/88 |

FOREIGN PATENT DOCUMENTS

| | | | |
|---|---|---|---|
| EP | 2050850 | A1 | 4/2009 |
| WO | WO9100382 | A1 | 1/1991 |

OTHER PUBLICATIONS

Written Opinion in French for International application No. PCT/EP2016/070508, dated Oct. 31, 2016, 6 pages.

* cited by examiner

METHOD OF MANUFACTURING AN INTERIOR COVERING, NOTABLY A FLOOR COVERING FOR A MOTOR VEHICLE

TECHNICAL FIELD

The present invention relates to a method of manufacturing an interior covering, notably a floor covering for a motor vehicle, of the nonwoven type, i.e., integrated directly from fibers. The present invention also relates to a device for manufacturing this covering, and a covering made using this method.

BACKGROUND

Methods are already known in the state of the art for manufacturing interior coverings for motor vehicles, based on the use of a needlepunching machine of the DILOUR® type.

Such a needlepunching machine has the particularity of including conveyors covered with brushes used to form a homogeneous pile. To that end, needles of the needlepunching machine drive the fibers of a batt deposited on the conveyor through the bristles of the brushes.

The operation of such a machine, as well as its component members, is described in detail in EP 0,183,952.

Furthermore, EP 2,050,850 describes the use of a Dilour® machine comprising two needlepunching heads working on a shared conveyor to produce a covering of the pile type by associating two batts. Although this type of method leads to improving the appearance of products relative to a method based on a Dilour® machine with only one head, it does not make it possible to obtain dense enough piles to rival the piles produced using methods implementing yarns, for example tufted piles also used in the automotive field. It should, however, be noted that a tufted pile is much more expensive than a needlepunched product of the Dilour® type, such that it is typically reserved for high-end vehicles.

Also known in the state of the art, in particular according to EP 0,859,077, is a method for manufacturing a covering, comprising a step for producing a batt of fibers having a given average orientation relative to the machine direction, followed by a step for passing the batt of fibers through a loop-forming device comprising a set of rotary discs and stationary loop-forming elements, so as to generate undulations.

Each fiber is oriented in a direction forming an angle $\alpha$ with the machine direction, this angle $\alpha$ being given by a relationship between the inter-disc distance and the desired height of the undulations. If this angular value is respected, the fibers will be made perfectly parallel in the undulations and the forces generated in the device will not be too high, which preserves the integrity of the fibers.

These undulations are next deposited on the substrate, for example a mat of glass fibers previously coated with an adhesive, for example a plastisol. After passing in the furnace, the plastisol gels and traps the fibers making up the base of the undulations.

This method, which allows very high pile densities comparable to, or even exceeding, tufted pile, is for example used to produce a pile-type covering for applications in residences essentially as a floor covering, in particular by subsequently carrying out a shearing or "slitting" step of the structure made up of the undulated fibers.

However, this method is not suitable for producing coverings applicable to the automotive field, since the resulting product is not formable, i.e., it is not able to marry the complex shapes for example of the floor of a motor vehicle.

Furthermore, the layer of adhesive used must be thick to ensure that the entire thickness of the base of the undulations is trapped, which has a significant impact on the mass and cost of the product.

This method also has the drawback of requiring the combination, on a same production line, of purely textile equipment (carding, burling line) and coating devices, therefore the creation of a specific production line. Yet textile and chemical means are typically separated to avoid any pollution problems.

SUMMARY

The invention in particular aims to resolve the aforementioned drawbacks of the state of the art, by providing an integrated method for manufacturing a covering of the pile type in particular for a motor vehicle, therefore fully formable, making it possible to achieve high pile densities and able to fit within an existing production line for textile coverings.

To that end, the invention in particular relates to a method of manufacturing a covering, notably a floor covering for a motor vehicle, comprising:

- a step for producing a batt of fibers, which is elongated in a longitudinal direction, by batting with interlacing of the fibers,
- a step for passing the batt of fibers, in the longitudinal direction, through a loop-forming device comprising a set of rotary discs and stationary loop-forming elements, so as to generate undulations, characterized in that it includes, following the passing step, a step for bringing the batt of fibers onto a conveyor equipped with brushes, and accumulating the undulations in the brushes so as to achieve a predetermined density.

Contrary to the teaching of the state of the art, in particular EP 0,859,077, which encourages the use of an adhesive to block the undulations of fibers, the invention provides for temporarily blocking the structure made up of the densified undulations of fibers inside brushes of the conveyor of a Dilour machine, i.e., by purely mechanical trapping and therefore without it being necessary to use an adhesive.

The invention next makes it possible to cause the undulations to penetrate more deeply inside the brushes until potentially reaching the depth corresponding to the desired height of the pile for the finished product.

By associating a second nonwoven batt, which may for example be a batt previously needlepunched on a traditional needlepunching unit of the "spunbond" type (with a base of continuous filaments), by needlepunching on the same brushes of the conveyor, by using the needlepunching head of the Dilour® machine, it is then possible to produce a covering having a pile (essentially made up of the undulations derived from a device similar to that of EP 0,859,077) with a selected density and a cohesive and formable back essentially made up of the second nonwoven batt.

The pile as such is generated by the subsequent trimming of the undulations.

Advantageously, the undulations are formed by loops each having a predefined width in a transverse direction perpendicular to the longitudinal direction, and a predefined height in an elevation direction perpendicular to the longitudinal and transverse directions including, the manufacturing method including, prior to the passing step, an step for orienting the fibers parallel to a general direction forming an angle $\alpha$ with the longitudinal direction, given by the relationship sin $\alpha$=G/2H to within +/−5°, the orientation step for example being carried out by stretching the batt of fibers whereof the fibers are interlaced.

Indeed, the inventors have noted that the orientation of the fibers of the batt, before the passage of this batt in the loop-forming device, play an important role in the final appearance obtained for the covering.

They have further established a relationship between the optimal angle formed between the general direction of the fibers and the longitudinal direction of the batt (which is also the movement direction of the batt in the loop-forming device) and the shape of the undulations, in particular their width and height.

It should be noted that the width and the height of the undulations are predefined, the width depending on the interval between two adjacent rotary discs, and the height in particular depending on this interval and the initial length of the fibers.

The desired height and width for the undulations being known, the optimal orientation angle of the fibers is determined using the relationship established by the inventors.

The step for orienting the fibers is therefore carried out to orient the fibers according to this optimal angle.

A method according to the invention may further include one or more of the following features, considered alone or according to any technically possible combinations:

- The method includes, following the bringing step: a step for needlepunching the batt of fibers through the brushes, to form a structure comprising a warp layer and a base, a step for removing the structure from the brushes, and a step for blocking the fibers of the warp layer in the base.
- The step for blocking the fibers in the base is carried out using a latex or binding fibers.
- The method includes, following the blocking step, a step for trimming the apex of the undulations accumulated in the structure, to thus form a pile.
- The method includes, before the needlepunching step, a step for depositing a reinforcing batt, preferably pre-needlepunched, on the accumulated undulations, the needlepunching assembling this reinforcing batt with the accumulated undulations, this reinforcing batt being intended to form at least part of the base during the needlepunching step.
- The batt of fibers, comprising undulations, has a sufficient height so that, when this batt of fibers is positioned in the brushes, part of the fibers protrudes from 1 to 10 mm above the brushes, the fibers of this part interpenetrating one another during the needlepunching step to reinforce the base or to form the base.

The invention also relates to a device for manufacturing a covering, in particular a floor covering for a motor vehicle, comprising:

- a batting device with interlacing fibers, able to produce a batt of fibers, which is elongated in a longitudinal direction,
- a loop-forming device comprising a set of rotary discs and stationary loop-forming elements, able to accommodate the batt of fibers in the longitudinal direction, and able to generate the undulations, characterized in that it includes, at the outlet of the loop-forming device, a conveyor equipped with brushes.

A manufacturing device according to the invention can further comprise one or more of the following features, considered alone or in any technically possible combinations:

- The loop-forming device is able to generate undulations formed by loops each having a predefined width G in a transverse direction perpendicular to the longitudinal direction (X), and a predefined height H in an elevation direction perpendicular to the longitudinal (X) and transverse directions, the manufacturing device further comprising a device for orienting the fibers parallel to a general direction forming an angle $\alpha$ with the longitudinal direction, given by the relationship sin $\alpha$=G/2H to within +/−5°.
- The orientation device is a device for stretching the batt of fibers, the fibers of which are interlaced, in particular comprising first and second sets of cylinders for driving the batt, the driving cylinders of the first set being rotatable with a speed different from that of the driving cylinders of the second set, in particular a lower speed.
- The device includes a needlepunching device, able to needlepunch the batt of fibers through the brushes, to form a structure comprising a warp layer and a base.

The invention lastly relates to a covering, in particular a floor covering for a motor vehicle, characterized in that it comprises a warp layer of unbonded fibers that are parallel to one another, and a back layer forming a base essentially formed by fibers bonded to one another, the warp layer having a pile outer appearance made up of fibers in the form of loops or individual fibers, the pile density in the warp layer being comprised between 0.05 and 0.1 g/cm$^3$.

BRIEF DESCRIPTION OF THE DRAWINGS

The invention will be better understood using the following description, provided solely as an example and done in reference to the appended figures, in which.

DETAILED DESCRIPTION

Figure 1:
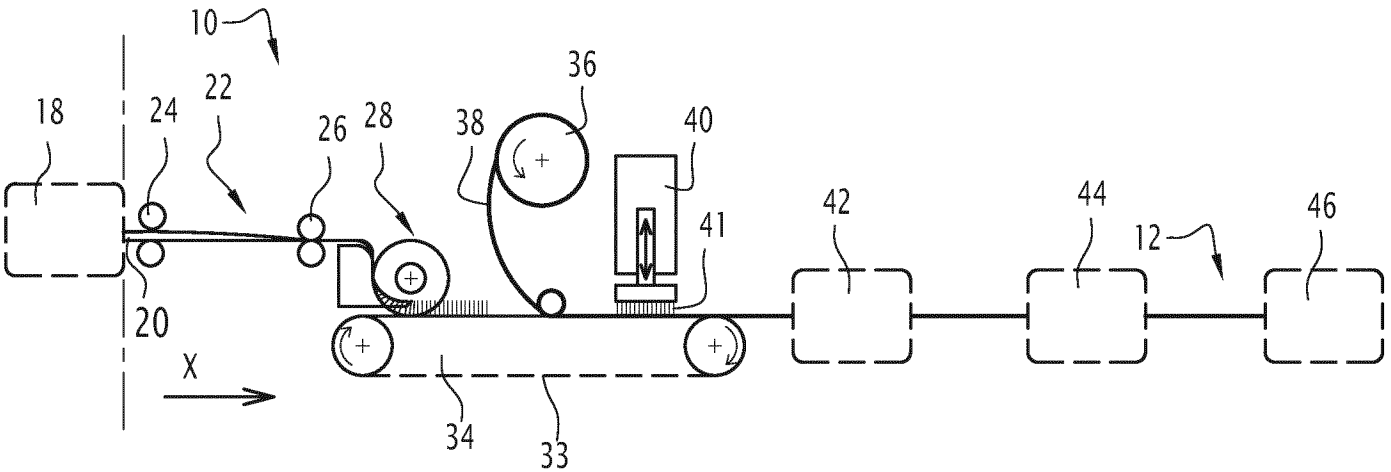
FIG. 1 schematically shows a device for manufacturing a covering according to one example embodiment of the invention.

FIG. 1 shows a device 10 for manufacturing a needlepunched covering 12.

Figure 2:
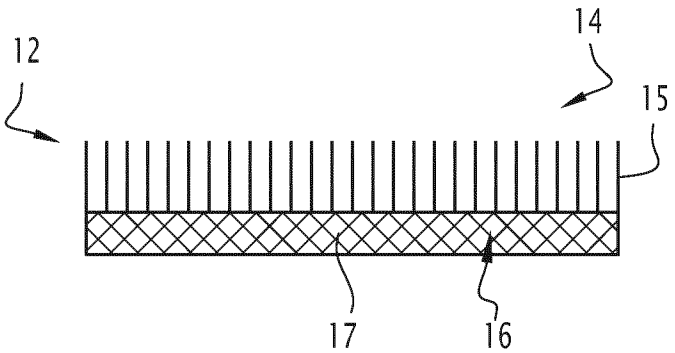
FIG. 2 is a schematic profile view of a covering manufactured using the device of FIG. 1.
Figure 3:
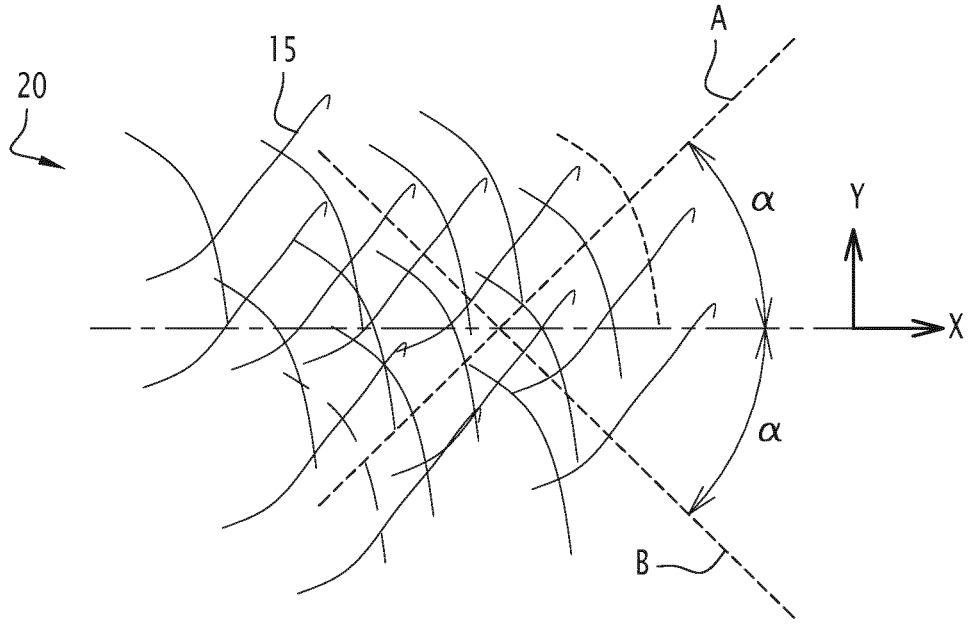
FIG. 3 is a schematic top view of fibers of a fiber batt passing in the device of FIG. 1, oriented according to the inventive method.

The covering 12 is shown in more detail in FIG. 2. This covering 12 for example forms an inner covering, and more particularly an inner covering of a motor vehicle, intended to be placed on the floor or on a wall of the vehicle. Alternatively, the covering 12 may form any possible interior covering.

The covering 12 has a warp layer 14 of unbonded fibers 15 that are parallel to one another, and a back layer 16 forming a base essentially formed by fibers 17 bonded to one another.

The fibers 15 and 17 are for example made with a base of a thermoplastic polymer, such as polypropylene, polyethylene terephthalate (PET), polyamide, polylactic acid, or mixtures or copolymers thereof. Alternatively, the fibers 15 and 17 can be natural fibers such as linen or hemp fibers used alone or in mixtures.

The fibers 15 and 17 can be of different natures. For example, the fibers 15 can have a base of polyamide, while the fibers 17 have a base of PET.

The layers 14 and 16 can be formed from a mixture comprising a percentage of bonding fibers, i.e., bi-component fibers for which one of the components has a melting temperature lower than that of the other.

The warp layer 14 has a pile outer appearance. This pile is made up of fibers 15 in the form of loops or individual fibers (trimmed loops).

The thickness of the warp layer 14 is generally greater than that of the base 16. The warp layer 14 for example has a thickness comprised between 2 and 8 mm.

The density of the pile in the warp layer 14 is preferably comprised between 0.05 and 0.1 g/cm$^3$, for example between 0.07 and 0.08 g/cm$^3$. Such a density ensures a pleasing appearance, good abrasion resistance and ease of cleaning.

This density is for example measured by determining the ratio between the mass of the material obtained by shaving the entire warp layer 14 down to the base 16, related to the initial volume of the shaved layer.

The output of the pile, made up of the ratio of the weight of the pile after total shaving down to the base to the total weight of the part 12, is for example comprised between 50 and 80%.

The length of the fibers used is generally comprised between 40 and 90 mm.

The count of the fibers is preferably comprised between 4 and 17 dtex.

The crimp of the fibers is preferably comprised between 2.5 and 4 undulations per cm.

The manufacturing device 10 includes a carding device followed by a batting device 18 (known as a lap machine) with interlacing fibers, able to produce a batt 20 of fibers.

The carding operation is done traditionally and makes it possible to obtain a web with a basis weight comprised between 40 and 120 g/m$^2$. Such a web is formed by individualized fibers, the majority of which are oriented in a longitudinal direction, corresponding to a production direction (machine direction). Nevertheless, these fibers overlap slightly due to their crimp; it is allowed that the main angle relative to the longitudinal direction of this type of web is comprised between 5 and 10° (this is considered in a half-plane relative to the axis of the longitudinal direction, since the fibers are positioned symmetrically relative to this axis). Subsequently and to facilitate the description, we will assume that this value, unless otherwise indicated, is close to 0°.

The batting device 18 is of a traditional type, and will therefore not be described in more detail. The particularity of the use of this device in the context of the invention is that only one fold is made, such that the fibers 15 interlaced by the lap machine extend parallel to a direction forming a mean angle β of about 60° with the longitudinal direction X, obviously in the case where the batting width corresponds to the carding width.

At this stage of the method, the batt is therefore made up of two superimposed webs, the majority of the fibers of which are oriented with a mean angle β of 60° symmetrically relative to the longitudinal axis X embodying the machine direction.

The manufacturing device 10 includes, after the batting device 18, a device 22 for orienting the fibers 15 of the batt of fibers 20. This orientation device 22 can be positioned at the outlet of the batting device 18, or alternatively can be positioned at a distance, in which case the batt of fibers 20 is moved from the batting device 18 toward the orientation device 22.

The orientation device 22 is able to modify the orientation of the fibers, initially oriented with the mean input angle β, to make them parallel to a general direction A, B forming a predetermined mean angle α with the longitudinal direction X. The fibers being interlaced, some are aligned parallel to a first general direction A forming an angle α with the longitudinal direction X in a clockwise direction, and others are aligned parallel to a second general direction B forming an angle α with the longitudinal direction X in a trigonometric direction.

Figure 4:
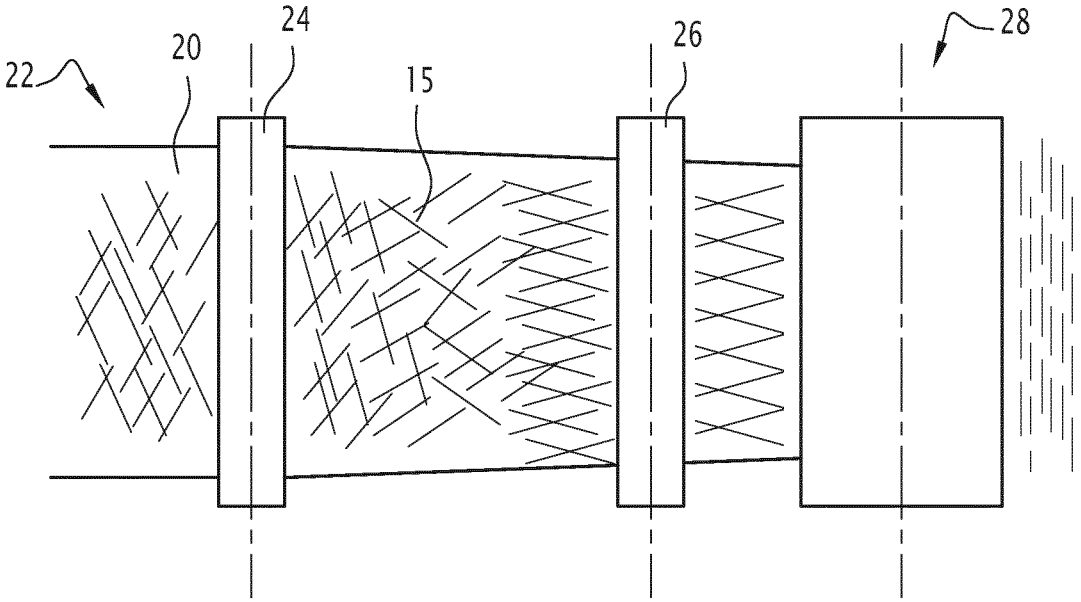
FIG. 4 is a top view of part of the device of FIG. 1, showing a device for orienting the fibers of the batt and a loop-forming device.
Figure 5:
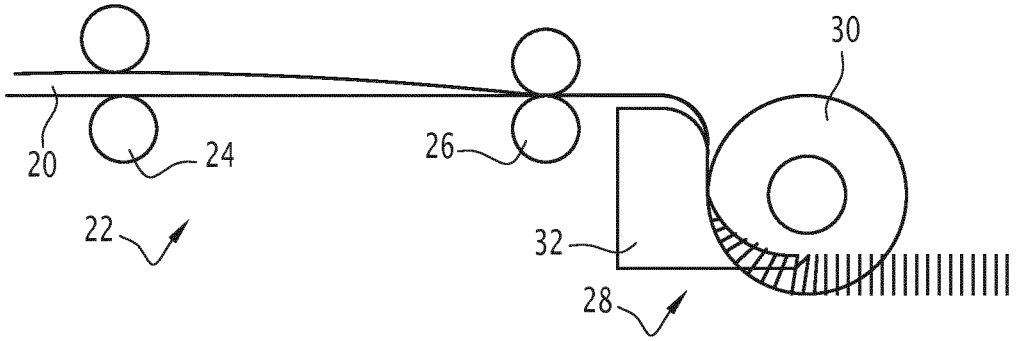
FIG. 5 is a profile view of the orientation device and the loop-forming device of FIG. 4.

The orientation device 22, shown in more detail in FIGS. 4 and 5, is for example a device for stretching the batt of fibers 20 whereof the fibers are interlaced. This stretching device 22 comprises a first set 24 of upstream driving cylinders, and a second set 26 of downstream driving cylinders. Each set 24, 26 includes two additional cylinders between which the batt 20 passes, in contact with these two cylinders. The rotational driving of the cylinders of each set 24, 26 therefore allows the batt 20 to be driven along the longitudinal direction X.

This device 22 is, strictly speaking, an orientation device and not a stretching device, even though the basis weight of the batt decreases between the two sets of cylinders, since its role is to pivot the fibers relative to one another (their point of intersection serving as pivot point) and not to stretch the batt by causing the fibers to slide parallel to one another like in a traditional textile stretching device. As a result, an effort is made to position the two sets of cylinders as close together as possible. Thus, if L is the length of the fiber 15, the distance between the nips of the two sets of cylinders will be slightly greater than L. cos β.

Nevertheless, we may subsequently speak of stretching and stretched batt in reference to this variation in basis weight of the batt.

The downstream driving cylinders of the second set 26 are rotatable with a rotation speed greater than that of the upstream driving cylinders of the first set 24, such that the batt of fibers 20 is not driven with the same speed over its entire length. This batt of fibers 20, passing between the cylinders of each set 24, 26, is then stretched due to this difference in speed.

This stretching makes it possible to align the fibers 15 of the batt 20 parallel to the desired general directions A and B.

Reference $V_e$ will denote the peripheral speed of the input cylinders, and $P_e$ the basis weight of the batt that is engaged between the input cylinders, $V_s$ the peripheral speed of the output cylinders, and Ps the basis weight of the batt that is engaged between the input cylinders. Reference α denotes the main angle of the fibers relative to the longitudinal direction X of the output batt.

This yields the following relationship: E (stretching)=Ve/Vs=Pe/Ps=cos α/cos β.

It is thus possible to determine the value of E as a function of the desired angle α and the angle β, which depends on the width of the carded output web and the batting width.

This yields tan β=2 Ln/Lv, with Ln the batting width and Lv the width of the web.

Thus, if Lv=Ln (for example in the case of a card 2.5 m wide for a batting of 2.5 m corresponding to the width of the finished product), which will generally be the case, $\beta \approx 60°$.

If, for example, the desired value of $\alpha$ is 20°, one will therefore have E=cos 20°/cos 60°=1.8.

We have described a stretching device made up of two sets of cylinders, but this stretching could be done by different means. For example, it could be done between the end of the intake mat of the batt and the discs of the device 130.

The manufacturing device 10 includes, at the outlet of the orientation device 22, a known loop-forming device 28, for example partially similar to that described in EP 0,859,077. Such a loop-forming device 28 is intended to loop the fibers 15 of the batt 20 while making them vertical, thus forming undulations.

This loop-forming device 28 includes a set of rotary discs 30 carried on a shared transverse axis, rotated continuously at a peripheral speed preferably equal to the input speed of the web 20 in this loop-forming device 28.

The rotary discs 30 are preferably each provided on their periphery with teeth allowing the web of fibers 20 to be driven.

The loop-forming device 28 also includes loop-forming fingers 32, each being positioned between two adjacent discs 30. The loop-forming fingers 32 extend to an end that is substantially tangential with respect to the discs 30. Thus, each fiber 15 is pre-looped while being driven at each end by a respective disc 30, while topping the corresponding loop-forming finger 32 positioned between these two discs 30.

Figure 6:
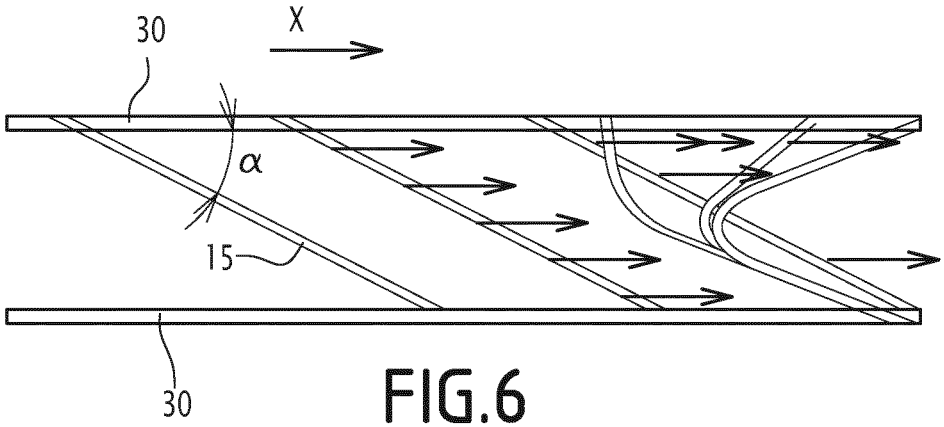
FIG. 6 is a schematic view of the evolution of a fiber passing in the loop-forming device of FIGS. 4 and 5.

The conveyance of a fiber 15 between two adjacent discs 30 is shown schematically in FIG. 6.

The fiber 15 has an angle $\alpha$ with the longitudinal direction X, which is also the direction of advance of the web 20 in the loop-forming device 28.

A front part of the fiber 15 is driven by one of the discs 30, and a rear part of this fiber 15 is driven by the other disc 30. These two discs being secured with a same axis, they have identical rotation speeds.

The front part of the fiber 15 arrives at the end of its travel first, against a stop that will be described later. While the front part is abutting, the rear part continues to advance until it is also abutting, thus curving the fiber 15, which then forms a loop.

The fibers 15 passing in the loop-forming device 28 all have the same behavior as described above, such that the set of fibers looped fibers 15 forms undulations on the width of the batt 20, considered in a transverse direction perpendicular to the longitudinal direction X.

Figure 7:
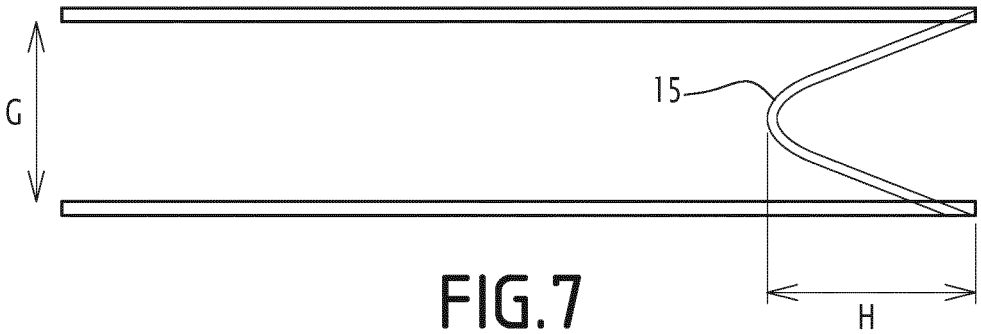
FIG. 7 shows the fiber of FIG. 6 after it passes through the loop-forming device.
Figure 8:
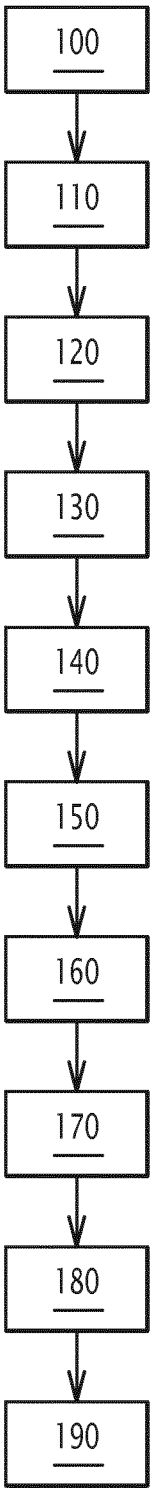
FIG. 8 schematically shows the steps of a method for manufacturing a covering, using the device of FIG. 1.

Each loop has a height H, considered in an elevation direction perpendicular to the longitudinal direction in the transverse direction, and a width G considered in the transverse direction, as shown in FIG. 7. It should be noted that the width G corresponds substantially to the interval between two adjacent discs 30.

The discs are positioned such that they penetrate, by a depth $P \leq H$, the inside of the brushes of a belt 33 of the same type as the brushes equipping the conveyor of a Dilour® machine. With respect to the discs, the bristles making up the brushes are flexible enough to separate and come back together in the free space between the discs.

It has surprisingly been possible to see that this type of strip could be used as a stop as previously mentioned, according to the principle described in EP 0,859,077. Indeed, when they are no longer in the presence of the discs, the brush bristles, regaining their initial position, exert pressure on the fibers, which makes it possible to block, then maintain the structure of the undulations.

In particular, under certain conditions to which we will return later, this penetration depth P may correspond exactly to H, looping height.

The aforementioned stop is therefore made up of a belt 33 of a conveyor 34. The belt 33 is an endless belt, extending between two driving cylinders. The belt 33 is provided with brushes.

The belt 33 is moved, in the longitudinal direction X, with a speed lower than the tangential speed of the rotary discs 30, such that they act as a stop for the fibers 15 leaving these rotary discs 30.

The undulations then accumulate on the brushes of the belt 33, with a density depending on the difference in speed between the rotary discs 30 and the belt 33. One skilled in the art will know how to determine this difference in speed based on the desired density.

For example, if the desired basis weight of the pile is 300 g/m$^2$ and if the batt after stretching has a basis weight of 50 g/m$^2$, the ratio of the speeds between the conveyor and the peripheral speed of the discs will be 300/50=6. This high ratio guarantees the operation according to the "stop" logic of EP 0,859,077.

This device makes it possible to obtain a high pile density, which is generally not achievable using traditional methods.

The brushes also prevent the fibers 15 from being driven upward by the discs 30, which would be detrimental to the formation of the undulations.

The manufacturing device 10 next includes a device 36 for depositing a reinforcing batt 38 on the undulations accumulated on the brushes. The reinforcing batt 38 is generally formed by fibers 17, for example of the same type as those of the batt 20.

The structure formed by stacking undulated fibers 15 and this reinforcing batt 38 is next intended to pass under a needlepunching device 40 or needlepunching head, comprising at least one needle bed 41.

The assembly formed by the brush conveyor 34 and the needle beds is known in itself, and for example formed by a machine of the Dilour® type.

The needle bed 41 is positioned across from the belt 33 of the conveyor 34, and it is vertically deployable toward this belt 33 to pierce said structure.

The needle bed 41 bears a plurality of needles, allowing a needlepunching density of about 200 to 400 cps/cm$^2$.

This needle bed 41 makes it possible to secure the reinforcing batt 38 to the structure made up of the undulations, i.e., the batt 20 completely or partially deposited inside the brushes, by extracting fibers from the batt 38 and causing them to penetrate the batt 20.

The penetration depth of the fibers of the batt 38 in the batt 20 allowing this assembly of the batt 38 on the batt 20 can be variable, starting from a low value of about 0.5 to 1 mm up to the penetration depth P, in which case the fibers of the batt 20 will also contribute to feeding the pile of the batt 20. This penetration depth, which can therefore vary from 0.5 mm to H, will be determined by the type of needles equipping the needlepunching head of the Dilour® machine, and the nature of the batt 38.

During this step, the warp layer 14 is formed, as well as the base 16, by intertwining the fibers 15 with the fibers 17 of the reinforcing batt 38.

The device 10 next includes a device for bonding the fibers of the warp layer 14 in the base 16. This bonding device 42 is for example a thermosetting device, in particular an air pass-through furnace or an infrared furnace.

The bonding can be done in any possible manner, for example by incorporating a latex into the reinforcing batt 38, or between the reinforcing batt 38 and the batt of fibers 20, or by incorporating thermofusible bonding fibers from among the fibers of the batt of fibers 20 and/or in the reinforcing batt 38. Bonding fibers are generally preferred to latex, for recyclability reasons. This bonding, which is necessary for all constructions of the needlepunched type to ensure sufficient cohesion of the fibers of the pile with the base and to avoid tearing or abrasion problems, is done traditionally and will therefore not be described in more detail.

Optionally, the device 10 next has a device 44 for trimming the apex of the accumulated undulations of the structure, to thus form a pile with vertical fibers. Because the undulations are made vertical in the loop-forming device 28 and the fibers are consequently perfectly parallel, the trimmed fibers all have the same height, such that the appearance of the pile is optimized. It should be noted that the scraps of trimmed fibers can later be recycled.

Lastly, the device 10 includes a device 46 for winding the formed covering 12, so that it may be handled.

It should be noted that, in order for the pile to have an optimal appearance, in particular an optimal density, and so that it does not have fibers prematurely broken in the loop-forming discs, which would be detrimental to its general appearance, the orientation angle $\alpha$ of the fibers must respect the relationship $\sin \alpha = G/2H$ to within +/−5°. The orientation of the fibers according to this angle $\alpha$ is done by the configuration of the orientation device 22.

Examples of angles $\alpha$ are given in the table below $\alpha = f(G,H)$, as a function of the width G and the height H of the undulations.

| | H = 4 mm | H = 6 mm | H = 8 mm | H = 10 mm | H = 15 mm | H = 20 mm |
|---|---|---|---|---|---|---|
| G = 1.5 mm | 11° | 7° | 5° | 4° | 3° | 2° |
| G = 2 mm | 15° | 9.5 | 7° | 6° | 4° | 3° |
| G = 2.5 mm | 18° | 12° | 9° | 7° | 4.5° | 3.5° |
| G = 3 mm | 22° | 14.5° | 11° | 8.5° | 5.5° | 4° |

Thus, for a distance G of 2.5 mm and a desired height H of 4 mm, the loop-feeding device should be supplied with a batt of fibers oriented at about 18°. This configuration makes it possible to approach the appearance of a tufted pile with a cut of 1/10 of an inch generally used in the automotive field.

The device according to the invention makes it possible to carry out a method for manufacturing a needlepunched covering that will now be described according to a first embodiment.

The manufacturing method includes a step 100 for producing a web, then a batt of fibers 20 including only one fold, by batting with interlacing of the fibers.

The manufacturing method next includes a step 110 for orienting the fibers 15 parallel to the first A or second B general direction, each forming an angle $\alpha$ (in the clockwise direction or in the trigonometric direction, respectively) with the longitudinal direction X. This orientation step 110 is carried out using the orientation device 22, configured such that the angle $\alpha$ satisfies the relationship $\sin \alpha = G/2H$, to within +/−5°, G and H being predetermined.

More particularly, G corresponds to the interval between two discs 30, and H corresponds to the desired height of the pile in the finished product optionally increased by the value corresponding to the loss due to trimming (generally between 0.5 and 1 mm).

The method next includes a step 120 for passing the batt of fibers 20, in the longitudinal direction X, through the loop-forming device 28, so as to generate undulations having a predefined length G in the transverse direction, and a predefined height H in the elevation direction.

The manufacturing method next includes a step 130 for bringing the batt of fibers 20 onto the conveyor 34 equipped with brushes, and accumulating the undulations in the brushes so as to achieve a predetermined density. The conveyor 34 is arranged at the outlet of the discs 30, such that this bringing step 130 is done by the discs 30. The discs penetrate the brushes by a depth P equal to the height H.

As previously indicated, the density of undulations depends on the difference in speeds between the discs 30 and the belt 33.

If one wishes to have a density for the finished product of 0.05 g/cm$^3$ for a final height in the product of 4 mm, or 5 mm before trimming (H=5 mm), this means that the basis weight of the pile must be 0.05×5×100=250 g/m$^2$.

If the basis weight of the batt after stretching is 50 g/m$^2$, the speed ratio between the peripheral speed of the discs and the speed of the brush conveyor must be 250/50=5.

It should be noted that the undulated fibers thus accumulated are perfectly parallel to one another, such that the appearance of the produced covering 12 is optimal.

The method next includes a step 140 for depositing the reinforcing batt 38, preferably pre-needlepunched, on the accumulated undulations. This reinforcing batt 38 is intended to form at least part of the base 16.

The method next includes a step 150 for needlepunching the batt of fibers 20 through the brushes of the belt 33, to form the structure comprising the warp layer 14 and the base 16, according to a traditional needlepunching method. As previously indicated, this needlepunching is done by a single needlepunching head. It should be noted that the needlepunching head is preferably provided with needles of the "crown" type, i.e., needles having only one barb per edge situated at the same distance from the tip. This type of needle is compatible with the use of brushes and allows effective interpenetration of the fibers of the batt 38 in the batt 20. The needlepunching head is not used here to extract fibers from the batt 20 to form a pile, which would be the operating logic of a Dilour® machine, but indeed to associate two batts the way a traditional needlepunch would do.

Such a needlepunching step 150 is advantageous to produce said structure, in particular relative to the method described in EP 0,859,077, in which the warp layer is chemically bonded, in particular by adhesion, to the base. Indeed, a covering obtained by the method according to EP 0,859,077 is then not thermoformable due to the presence of the adhesive, and is therefore not suitable for producing a motor vehicle floor covering, which traditionally requires such thermoforming.

Owing to the needlepunching step 150, the covering made using the method according to the invention is thermoformable, therefore completely suitable for producing motor vehicle floor coverings.

The method next includes a step 160 for removing the structure thus formed from the conveyor 34.

The method next includes a step 170 for blocking or bonding the fibers of the warp layer 14 in the base 16. This blocking step 170 is carried out in the blocking device 42, by any possible means.

The method next includes a step 180 for trimming the apex of the undulations accumulated in the structure. This step is optional, but a trimmed covering is easier to clean than an untrimmed covering, the loops of which retain dirt.

Lastly, the method includes a step 190 for winding the formed covering 12, so that it may be handled.

A second embodiment will now be described.

This second embodiment is identical to the first embodiment until the bringing step 130. At this stage, the position of the discs is adjusted so that the penetration P is smaller than the desired height H, for example about 1 to 2 mm.

This operating mode is suitable when the desired density is relatively high, generally beyond 0.05 g/cm$^3$, and/or when the fibers have a count below 11 dtex. Indeed, in this case, the bulk caused by the accumulation of the fibers between the brush bristles is such that the rubbing between fibers and discs increases considerably, which causes accumulated fibers to be driven by the discs, the brushes no longer managing to play their role in terms of abutment and maintenance of the undulations.

In this case, if one wishes for a product definition according to the first embodiment, the fibers should be made to penetrate the brushes to the penetration value H by a second device corresponding to an additional step for "additional penetration".

This second device for example includes a second set of disks without teeth separated from one another by a distance G and positioned in exactly the same vertical planes as the loop-forming discs 30 and rotating at a peripheral speed close to the speed of the conveyor, or alternatively includes a comb equipped with "teeth" also separated from one another by a distance G, positioned in the exact extension of the discs, the comb being driven in an alternating movement.

Alternatively, the penetration P done by this second device can remain smaller than H by a small value, for example of 1 mm. In this case, the height of the loops making up the pile before trimming will have a value P=H−1 mm. The material corresponding to this millimeter remaining above the brushes will participate in the base and reinforce the anchoring of the batt 20 in the base.

The other steps of the method according to this second embodiment remain identical to the first embodiment.

A third embodiment will now be described.

This third embodiment is substantially identical to the second embodiment, inasmuch as the undulations with a height H are made during the bringing step 130 for an additional penetration P during said additional penetration step in the brushes, but here with H>>P. For example, H=10 mm for P=5 mm.

In this case, the deposition step 140 may prove unnecessary. Indeed, the base may be made up of the material corresponding to the 5 mm having remained above the brushes without it being necessary to add additional material through a second batt 38. In this case, the needlepunching will allow not the assembly of two batts, but the establishment of the base itself.

The batting step 100 may also be eliminated, since the angle produced by carding alone may then be sufficient. Indeed, the table $\alpha$=f(G,H) gives, for an inter-disc distance of 2.5 mm and a height H of 10 mm, a theoretical angle of 7° that is, as seen, in the range of mean angles of a carding web.

This third embodiment is particularly advantageous, since it greatly simplifies the method and minimizes the investments (the lap machine is no longer necessary, nor is an auxiliary needlepunching line to manufacture the batt 38), in addition to which it guarantees perfect anchoring of the bristles making up the pile in the base, since a same fiber will participate in full both in the pile and the base. The abrasion performance of the covering will thus be greatly improved as a result.

It should be noted that, irrespective of the embodiment, the basis weight of the base (derived from the batt 38 or the structure of the batt 20 itself) can be adapted independently of the basis weight of the pile, unlike the product traditionally manufactured on a Dilour®. Thus, the basis weight of this base will be chosen to allow the thermoforming of the covering based on the required elongation's (i.e., depending on the more or less complex shape of the part of the vehicle to be covered) or generally between 100 and 200 g/m$^2$, which will lead to pile outputs as previously defined that are easily greater than 60%, whereas they do not exceed 30% for a traditional product of the Dilour® type.

It will be noted that the invention is not limited to the embodiments described above, and could assume various alternatives.

In particular, the use of stripping rolls as described in EP 0,859,077 could prove useful in particular to secure the operation and prevent any fibers from rising in the discs in case of accidental "jam".

Likewise, the applications of this type of covering could extend to sectors other than motor vehicles, for example homes or rail transport, even in cases where formability is not required.

It appears that the invention makes it possible to produce a pile covering having characteristics similar to those of a tufted covering, in particular in terms of pile density, the method according to the invention further being more economical than a traditional tufting method.

The invention claimed is:

1. A method of manufacturing a floor covering for a motor vehicle, comprising:

producing a batt of fibers, which is elongated in a longitudinal direction, by batting with interlacing of the fibers, passing the batt of fibers, in the longitudinal direction, through a loop-forming device comprising a set of rotary discs and stationary loop-forming elements, so as to generate undulations, wherein the method includes, following passing the batt of fibers through a loop-forming device, the steps of bringing the batt of fibers onto a conveyor equipped with brushes, and accumulating the undulations in the brushes so as to achieve a predetermined density.

2. The manufacturing method according to claim 1, wherein the undulations are formed by loops each having a predefined width G in a transverse direction perpendicular to the longitudinal direction, and a predefined height H in an elevation direction perpendicular to the longitudinal and transverse directions including, the manufacturing method including, prior to passing the batt of fibers through a loop-forming device, orienting the fibers parallel to a general direction forming an angle $\alpha$ with the longitudinal direction, given by the relationship sin $\alpha$=G/2H to within +/−5°.

3. The manufacturing method according to claim 2, wherein the orientation is carried out by stretching the batt of fibers whereof the fibers are interlaced.

4. The manufacturing method according to claim 1, including, after bringing the batt of fibers onto the conveyor:

needlepunching the batt of fibers through the brushes, to form a structure comprising a warp layer and a base, removing the structure from the brushes, and blocking the fibers of the warp layer in the base.

5. The manufacturing method according to claim 4, wherein blocking the fibers in the base is carried out using a latex or binding fibers.

6. The manufacturing method according to claim 4, including, following blocking the fibers in the base, trimming the apex of the undulations accumulated in the structure, to thus form a pile.

7. The manufacturing method according to claim 4, including, before needlepunching the batt of fibers, depositing a reinforcing batt on the accumulated undulations, the needlepunching assembling this reinforcing batt with the accumulated undulations, this reinforcing batt being intended to form at least part of the base during the needlepunching step.

8. The manufacturing method according to claim 4, wherein the batt of fibers, comprising undulations, has a sufficient height so that, when this batt of fibers is positioned in the brushes, part of the fibers protrudes from 1 to 10 mm above the brushes, the fibers of this part interpenetrating one another during the needlepunching to reinforce the base or to form the base.

9. A device for manufacturing a covering according to the method of claim 1, comprising:

a batting device with interlacing fibers, able to produce the batt of fibers, which is elongated in a longitudinal direction, and said loop-forming device comprising a set of rotary discs and stationary loop-forming elements, able to accommodate the batt of fibers in the longitudinal direction, and able to generate the undulations, wherein the device includes, at an outlet of the loop-forming device, said conveyor equipped with brushes.

10. A device for manufacturing a floor covering for a motor vehicle, comprising:

a batting device with interlacing fibers, able to produce a batt of fibers, which is elongated in a longitudinal direction, a loop-forming device comprising a set of rotary discs and stationary loop-forming elements, able to accommodate the batt of fibers in the longitudinal direction, and able to generate the undulations, wherein the device includes, at the outlet of the loop-forming device, a conveyor equipped with brushes.

11. The manufacturing device according to claim 10, wherein the loop-forming device is able to generate undulations formed by loops each having a predefined width G in a transverse direction perpendicular to the longitudinal direction, and a predefined height H in an elevation direction perpendicular to the longitudinal and transverse directions, the manufacturing device further comprising a device for orienting the fibers parallel to a general direction forming an angle $\alpha$ with the longitudinal direction, given by the relationship $\sin \alpha = G/2H$ to within $+/-5°$.

12. The manufacturing device according to claim 11, wherein the orientation device is a device for stretching the batt of fibers, the fibers of which are interlaced, in particular comprising first and second sets of cylinders for driving the batt, the driving cylinders of the first set being rotatable with a speed different from that of the driving cylinders of the second set, in particular a lower speed.

13. The manufacturing device according to claim 10, further comprising a needlepunching device, able to needlepunch the batt of fibers through the brushes, to form a structure comprising a warp layer and a base.

14. A floor covering for a motor vehicle, comprising a warp layer of unbonded fibers that are parallel to one another, and a back layer forming a base essentially formed by fibers bonded to one another, the warp layer having a pile outer appearance made up of fibers in the form of loops or individual fibers, the pile density in the warp layer being comprised between 0.05 and 0.08 $g/cm^3$.

* * * * *